US005717373A

United States Patent [19]

Vachris

[11] Patent Number: 5,717,373

[45] Date of Patent: Feb. 10, 1998

[54] CORNER INSULATION FOR TOROIDAL (ANNULAR) DEVICES

[76] Inventor: James E. Vachris, 5 Brendle La., P.O. Box 562, Montchanin, Del. 19710

[21] Appl. No.: 495,327

[22] Filed: Jun. 27, 1995

[51] Int. Cl.[6] ..... H01F 27/30; H01F 27/24

[52] U.S. Cl. ..... 336/206; 336/206; 336/219

[58] Field of Search ..... 336/206, 219; 310/43

[56] References Cited

U.S. PATENT DOCUMENTS

| | | | |
|---|---|---|---|
| 4,646,803 | 3/1987 | Hanaoka | 336/219 |
| 5,488,344 | 1/1996 | Bisbee | 336/206 |

FOREIGN PATENT DOCUMENTS

| | | | |
|---|---|---|---|
| 4-42514 | 2/1992 | Japan | H01F 27/24 |

*Primary Examiner*—Michael L. Gellner
*Assistant Examiner*—Anh Mai
*Attorney, Agent, or Firm*—E. Alan Uebler, P.A.

[57] ABSTRACT

An article of insulation, especially adapted for insulating corners, is provided. The article is constructed in the form of an elongated flexible sheet capable of sustaining and retaining at least one longitudinal fold therein and having generally a beginning end and a closing end and first and second, generally opposite longitudinal sides thereof. Each longitudinal side has a plurality of protrusions or tabs extending outwardly therefrom along the length of each side, with each protrusion being separated from adjacent protrusions such that, upon folding the sheet longitudinally along its centerline to form overlapping halves folded upon one another, the protrusions along the length of the first side overlap the separations along the length of the second side, and vice versa. The article has a second fold extending longitudinally thereof along the bases of the protrusions such that the overlapping protrusions form substantially a right angle with the remaining portion of the sheet. This folded, right-angle construction can be shaped into a desired curvilinear configuration. The sheet may be constructed of an electrically insulating material such as a cellulose paper or polyaramid paper, a coated fabric or a plastic layer or film. A vulcanized fibre paper is also suitable. The insulator is adaptable to fit the corners, both the outside diameters (OD) and the inside diameters (ID), of a rectangular or square cross-sectioned toroid, as well as a cylinder, or tubular constructions in general. The insulation is especially suited to protecting the corners of electromagnetic toroidal coils.

25 Claims, 2 Drawing Sheets

CORNER INSULATION FOR TOROIDAL (ANNULAR) DEVICES

BACKGROUND OF THE INVENTION

The invention relates generally to an article of insulation for the electrical insulation of corners of toroidal coils used in electromagnetic devices such as instrument transformers, power transformers and the like.

Generally speaking, a toroid is a geometrical configuration, that is, a surface or its enclosed solid, generated by any closed plane curve rotating about a straight line in its own plane. Thus, a toroid generated by a circular plane is doughnut-like in shape. A toroid formed by a rectangular plane is cylindrically annular in shape having a body whose cross-section is simply the generating rectangle. This toroid has four corners, namely corners at the upper and lower OD of the cylinder and corners at the upper and lower ID of the cylinder central opening.

A transformer is an electrical device that transfers electrical energy from one coil, or winding, to another by electromagnetic induction. The transferred energy may be at a higher or lower voltage. When the primary winding is energized by an AC source, an alternating magnetic flux is established in the transformer core. This flux links the turns of both primary and secondary, thereby inducing voltages in them. Because the same flux cuts both windings, the same electrical energy is induced in each turn of both windings. The total induced voltage in each winding is proportional to the number of turns in that winding. The typical transformer has two windings, insulated electrically from each other, wound on a common magnetic circuit of laminated sheet steel (the core). The core provides a circuit of low reluctance for the magnetic flux, or lines of force. In the coretype transformer, the windings surround the laminated metal core.

In electromagnetic applications, toroidal cores may be solid, made of soft iron and the like, or may be constructed of various turnings or windings of foil strips, wire, filaments, coiled flat metal or other such materials and shapes.

In multilayer windings of wire, filaments or anything flexible or semiflexible that is round in cross section, the overwrap or second layer of winding tends to crush into the lower windings, spreading them and changing the winding's geometric relationships. In the case of an electrical or magnetic coil, this causes a change in the spacing and positioning of the electrical design and results in a change in the electrical properties of the winding. Space relationship can be critical in electromagnetic coil winding designs. Such a crush down in winding layers is undesired. An interleaf or layer of insulation or a flat wrap separation is usually needed between widing layers. Such a layer at and around the corners is difficult to position in a manner providing effective electrical insulation.

In toroidal coils of special design and relative larger sizes, especially over about 6" diameter, the core is usually made from a soft magnetic lamination type steel. This is usually slit into a ribbon and coiled into a tightly wrapped ring or cylindrical annular shape. The edges (corners) of this magnetic steel toroid can be very sharp. The sharp edges, if mechanically removed, can change the electromagnetic properties of the final coil core design. To properly insulate this sharp edged metal from the windings of electric wire (such as copper or aluminum) is a costly and tedious task. Insulating washers and wraps have been employed and the core ends and layers of overwrap for the inside and outside diameters for such applications must be pre-cut, then applied to the core metal, and held and taped into place, prior to commencing further winding around the toroid. Either such washers or the diameter wraps must be slightly oversized to ensure that the metal corners are insulated sufficiently. No movement of this insulation can be permitted or the sharp corners can then be exposed and cause subsequent short circuits and damage the coil, either partially or completely.

In most electric devices there are many electrical wire or cable leads that require further insulation or protection after assembly or after use. In many cases the wires cannot be disconnected, and therefore, a solid tubular insulation cannot be simply slipped over the cable. If required, additional insulation may be installed in segments, which is an extremely labor-intensive operation.

In addition, in electric motor, generator, alternator, and similar apparatus repair, there are often components in need of additional insulation or protection. This is especially true at motor stator winding ends. Also, large and small size rolls of metal foils and other special rolled material may require corner protection on the outside diameter (OD) to prevent damage in handling or shipment. When shipping or transporting virtually any tubular shape, if the end corners need protection, a cap or circular cover must be provided. Such caps or covers are usually of one particular size and are generally not variable. To vary the cap or cover sizes, extensive tooling and set up would be required for manufacture. Varying inventory would also be required to cover the complete range of needed sizes.

The article of corner insulation according to the invention provides a convenient, inexpensive, easily installed and positioned insulating cover for the corners of toroidal (or generally right circular cylindrical, and tubular) devices and is especially suited to insulate and protect the corners of toroidal electromagnetic transformers and the like.

SUMMARY OF THE INVENTION

An article of insulation and protection, especially adapted for insulating corners, is provided. The article is constructed in the form of an elongated flexible sheet capable of sustaining and retaining at least one longitudinal fold therein and having generally a beginning end and a closing end and first and second, generally opposite longitudinal sides thereof. Each longitudinal side has a plurality of protrusions or tabs extending outwardly therefrom along the length of each side with each protrusion being separated from adjacent protrusions such that, upon folding the sheet longitudinally along its centerline to form overlapping halves folded upon one another, the protrusions along the length of the first side overlap the separations along the length of the second side, and vice versa. The article has a second fold extending longitudinally thereof along the bases of the protrusions such that the overlapping protrusions form substantially a right angle with the remaining portion of the sheet. The folded, right-angle construction can be shaped into a curvilinear configuration such that all protrusions are oriented in a concave relation with respect to one another (suitable for "outside" installations) or all protrusions are oriented in a convex relation with respect to one another (suitable for "inside" installations). Each protrusion extends from its base at a common plane of extension from the longitudinal sheet and each protrusion, in addition to the base, has two sides and an outer edge. Preferably each protrusion (tab) is generally rectangular or square in shape for convex applications. For concave applications, each outer edge of each tab is preferably somewhat shorter than each base to form tapered trapezoidal-like protrusions. The sheet is constructed of an electrically insulating material such as polyaramid paper, polyethylene terephthalate paper, vulcanized fibre paper, cellulosic paper or like material.

The corner insulator is adaptable to fit the corners, both OD and ID, of a rectangular or square cross-sectioned toroid, as well as a cylinder, or tubes generally.

The insulation is especially suited to protecting the corners of an electromagnetic toroidal coil.

DETAILED DESCRIPTION OF THE INVENTION AND PREFERRED EMBODIMENTS WITH REFERENCE TO THE DRAWINGS

An article of insulation, especially adapted for insulating corners, is provided. The article is constructed in the form of an elongated flexible sheet capable of sustaining and retaining at least one longitudinal fold therein and having generally a beginning end and a closing end and first and second, generally opposite longitudinal sides thereof. Each longitudinal side has a plurality of protrusions or tabs extending outwardly therefrom along the length of each side, with each protrusion being separated from adjacent protrusions such that, upon folding the sheet longitudinally along its centerline to form overlapping halves folded upon one another, the protrusions along the length of the first side overlap the separations along the length of the second side, and vice versa. The article has a second fold extending longitudinally thereof along the bases of the protrusions such that the overlapping protrusions form substantially a right angle with the remaining portion of the sheet. This folded, right-angle construction can be shaped into a desired curvilinear configuration. The sheet is constructed of an electrically insulating material such as a cellulose paper or polyaramid paper. Vulcanized fibre paper is also suitable. The insulator is adaptable to fit the corners, both OD and ID, of a rectangular toroid, as well as a cylinder, or tubular constructions in general. The insulation is especially suited to protecting the corners of electromagnetic toroidal coils.

Figure 1:
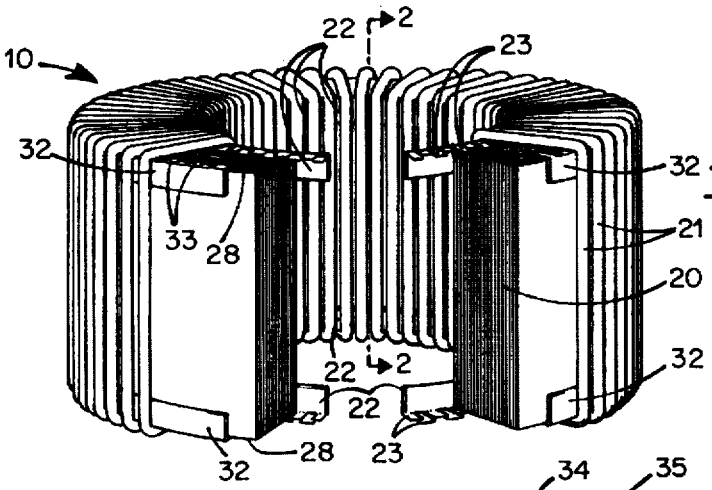
FIG. 1 is a perspective view of a toroidal coil core and winding such as that employed in electrical transformers and the like, the core having the article of insulation according to the invention installed on each of the four corners thereof; the view is shown partially broken away.

A detailed description of the invention and preferred embodiments is best provided with reference to the accompanying drawings wherein FIG. 1 is a perspective view, in part broken away, of an electrical toroidal coil core and winding having the insulating article of the invention installed at each of the four corners (2-OD and 2-ID) thereof. As shown in FIG. 1, the insulated wound toroidal coil 10 according to the invention includes a conventional metal foil or ribbon wrapped toroid core 20 wound with multiple windings of insulated wire 21. At each of the four corners of the toroid 20, two "ID" and two "OD", is positioned a corner insulating article of the invention having base sections 222 (ID) and 32 (OD) and protrusions or tabs 23 (ID) and 33 (OD) oriented at right angles to the bases 22 and 32. Each insulator separates and insulates the core 20 from the windings 21 at the corner edges 28 as shown.

Figure 2:
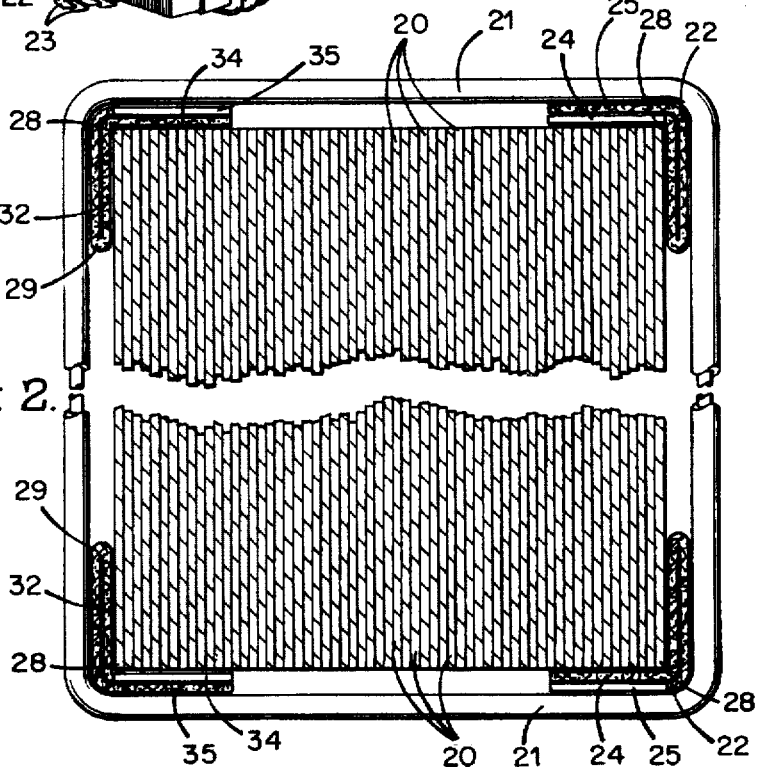
FIG. 2 is an enlarged cross-section of the toroidal coil of FIG. 1 taken along line 2—2 of FIG. 1.

An enlarged cross-sectional view of the insulated core/winding taken along line 2—2 of FIG. 1 is depicted in FIG. 2. The multiple laminate of core 20, overwrapped with multiple windings of wire 21, are shown separated from the wire 21 at the four corner edges 28 by the insulators of the invention. At the ID, the insulator base 22 extends at right angels to tabs 24, 25 (tabs 24, 25 are represented collectively as 22 in FIG. 1). At the OD, the insulator base 32 extends at right angles to tabs 34, 35 (tabs 34, 35 are represented collectively as 33 in FIG. 1). Reference character 29 denotes the primary fold in the insulating sheet, to be discussed more fully below.

Figure 3:
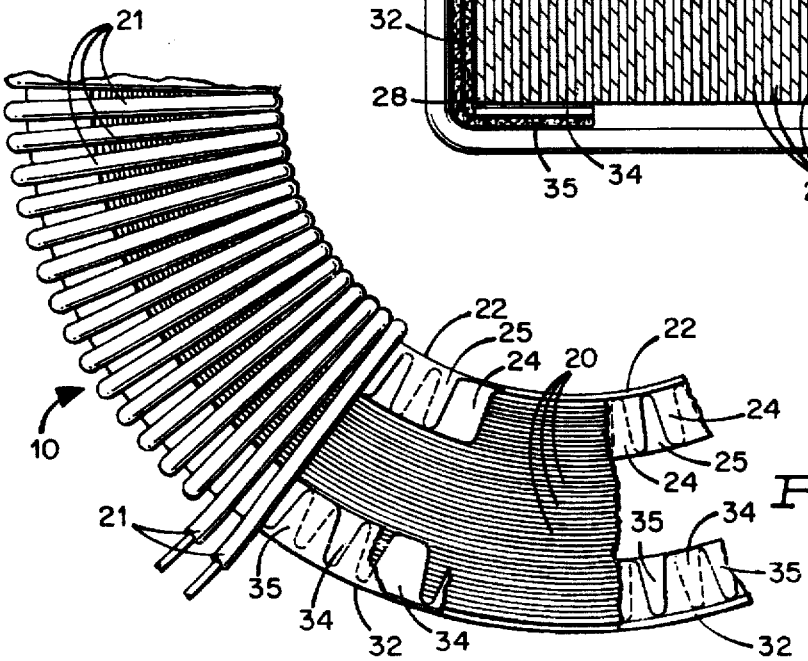
FIG. 3 is an enlarged top plan view of a portion of the toroid coil of FIG. 1, in part broken away, depicting the core, the insulated wire windings and the four corner insulators of the invention.

FIG. 3 shows a top plan view of a portion of the insulated, wound toroidal coil 10 showing core 20, winding 21 and both OD and ID corner insulators. The folded ID insulator base 22 has tabs 24, 25 oriented at right angles to base 22 and separating the core 20 from the winding 21 as shown. In similar fashion, the folded OD insulator base 32 has tabs 34, 35 extending perpendicularly therefrom separating the core and winding. Tabs 24, 34 come into contact with core 20 and tabs 25, 35 come into contact with the winding 21.

Figure 4:
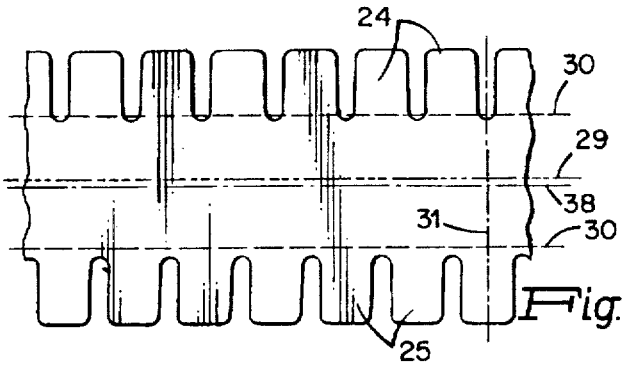
FIG. 4 is a top plan view of an article of insulation according to the invention in flat layout having its generally rectangular protrusions or tabs positioned in offset configuration, side-to-side, and extending longitudinally along both sides of the insulator.

FIG. 4 shows a top plan view of an ID or "inside curvilinear " insulator of the invention laid flat. Therein, each tab 24, 25 is shown to be generally rectangular. The sheet is fabricated so that the tabs along one side of the insulator have centerlines 31 which intersect and bisect the corresponding separations on the opposite side of the sheet as shown. The primary fold line 29 may not coincide exactly with the true centerline 38, but may be offset slightly to accommodate the thickness of the insulation sheet and obtain edge registry of opposite tabs after folding. Tabs 24, 25 are folded along secondary fold lines 30 as depicted in more detail in FIGS. 5A and 5B.

Figure 5A:
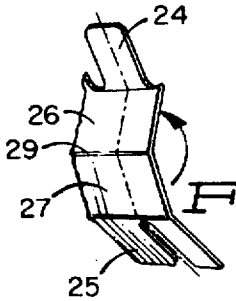
FIG. 5A depicts the fold configuration of the insulator in a partially folded condition.
Figure 5B:
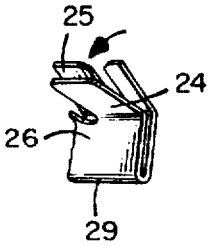
FIG. 5B depicts the fold configuration of the insulator of the invention in a fully folded configuration.

As shown in FIGS. 5A and 5B, the insulating sheet is folded first along primary longitudinal fold line 29 into a configuration having base components 26, 27 (referred to collectively as 22 in FIG. 1) and tabs 24, 25, all as indicated by the arrow, the tabs having desired separations therebetween as shown. Completing the folding, the insulator of the invention, especially adapted to convex "inside" applications, is shown in FIG. 5B. Therein, as indicated by the arrow, tabs 24, 25 are folded over at generally right angles with base 26.

Figure 6:
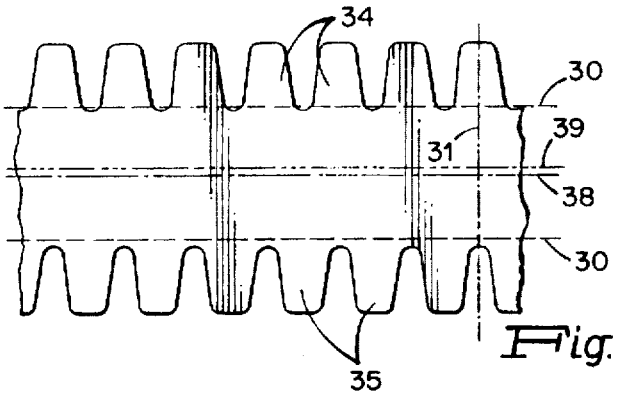
FIG. 6 is a top plan view of an article of insulation according to the invention in flat layout having generally trapezoidal protrusions or tabs positioned in offset configuration, side-to-side, as shown extending longitudinally along both sides of the insulator.

FIG. 6 depicts an alternate embodiment generally preferred for OD or "outside" applications. Therein the protrusions or tabs 34, 35 are tapered and have their outside edges somewhat shorter than their bases to form a trapezoidal shape. In this manner, continuous insulation along the entire curvilinear corner, with no significant gaps, is provided.

Figure 7:
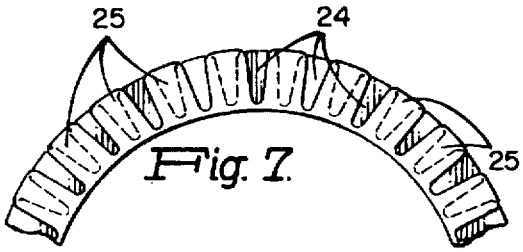
FIG. 7 is a top plan view of the insulating article of the invention depicted in FIG. 4 with overlapping tabs in the convex configuration with respect to one another, especially adapted to insulate and protect ID corners.
Figure 8:
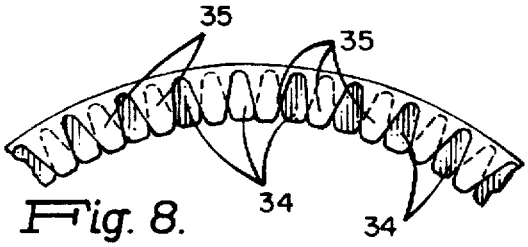
FIG. 8 is a top plan view of the insulating article of the invention depicted in FIG. 6 with overlapping tabs in the concave configuration with respect to one another, especially adapted to insulate and protect OD corners.

FIG. 7 shows a top plan of an ID "inside" insulator having convex, overlapping, generally rectangular or square tabs 24, 25. FIG. 8 shows a top view of an OD "outside" insulator having concave, overlapping, generally trapezoidal tabs 34, 35. In both cases, the article of insulation provides continuous insulation and protection of the corners 28 of the core 20 to which it is applied.

Figure 9:
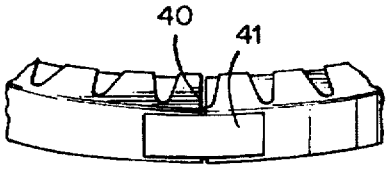
FIG. 9 shows the ends of an outside insulator of the invention forming a butt joint and means for holding the ends together.
Figure 10:
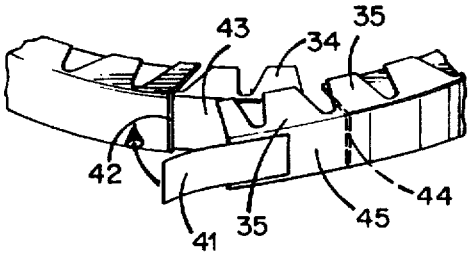
FIG. 10 shows the ends of an outside insulator of the invention forming an overlapping joint and means for holding these ends together.

For a given installation, an insulator sheet shown in FIGS. 4 or 6 is cut to the desired length, fitted to the appropriate core corner and fixed in place thereat. The joint may be a butt joint as shown in FIG. 9 or an overlapping joint as shown in FIG. 10. In many cases, the ends 40 of the insulator may be affixed together with tape 41 and overlapping repairs or splices may be easily cut to fit as shown in FIG. 10. The preferred insulation materials of construction for electrical applications include Nomex® calendered aramid paper, Style 410, marketed by DuPont, rag paper (electrical cellulose insulation) and vulcanized fibre paper. Other materials of construction for particular applications will be known to those skilled in this art, such as coated fabric materials and various forms of plastics. The material must be flexible such that it will conform to the contours of the corner of the desired application, and it must be foldable and capable of retaining the required folds prior to application. All of these materials are marketed by Franklin Fibre-Lamitex Corporation, Wilmington, Del.

While the invention has been disclosed herein in connection with certain embodiments and detailed descriptions, it will be clear to one skilled in the art that modification or variations of such details can be made without deviating from the gist of this invention, and such modifications or variations are considered to be within the scope of the claims hereinbelow.

What is claimed is:

1. An article of insulation comprising an elongated flexible sheet having a longitudinal fold therein along the centerline of said sheet, said sheet being folded longitudinally along said centerline thereof forming overlapping longitudinally oriented halves of said sheet folded upon one another, said folded sheet having generally a beginning end and a closing end, each of said longitudinal halves of said sheet having a plurality of protrusions extending outwardly therefrom along the length of each of said longitudinal halves, each of said protrusions being separated from adjacent protrusions such that the protrusions along the length of one of said halves overlap the separations along the length of the other of said halves, and vice versa, said sheet having a second fold extending longitudinally thereof along the bases of said plurality of protrusions such that the overlapping protrusions form an angle with respect to the remaining portion of said sheet.

2. The article of claim 1 wherein said angle is substantially a right angle.

3. The article of claim 2 shaped into a curvilinear configuration.

4. The article of claim 3 shaped into a concave configuration such that all said protrusions are oriented in a concave relation with respect to one another.

5. The article of claim 1 wherein each protrusion extends from its base at a common plane of extension from said longitudinal sheet and each protrusion has two sides and an outer edge.

6. The article of claim 5 wherein each protrusion is generally rectangular in shape.

7. The article of claim 5 wherein each protrusion is generally square in shape, that is, the base, sides and outer edge are all substantially equal.

8. The article of claim 5 wherein each said outer edge is shorter than its corresponding base to form tapered trapezoidal protrusions.

9. The article of insulation of claim 1 wherein said sheet is constructed of an electrically insulating material.

10. The article of claim 9 wherein said sheet is constructed of polyaramid paper.

11. The article of claim 9 wherein said sheet is constructed of polyethylene terephthalate paper.

12. The article of claim 9 wherein said sheet is constructed of vulcanized fibre.

13. The article of claim 9 wherein said sheet is constructed of cellulose.

14. The article of claim 3 shaped into a circular configuration.

15. The article of insulation of claim 14 affixed to both corners of both ends of a circular tube.

16. The article of claim 3 shaped into a convex configuration such that all said protrusions are oriented in a convex relation with respect to one another.

17. The article of insulation of claim 16 affixed to the corners of the ID of at least one end of a tube.

18. The article of insulation of claim 3 affixed to the corners of a generally rectangular toroid.

19. The article of insulation of claim 1 affixed to the inside corners of a generally rectangular toroid.

20. The article of insulation of claim 3 affixed to all corners of an electromechanical rectangular toroidal coil.

21. The article of insulation of claim 3 affixed to the corners of at least one winding of an electrical toroidal core to provide electrical insulation between said winding and at least one adjacent winding thereof.

22. The article of insulation of claim 3 affixed to the corners of the core and a plurality of windings of an electrical toroidal core and multiple windings to provide electrical insulation between said core and adjacent windings.

23. The article of insulation of claim 4 affixed to the outside corners of a generally rectangular toroid.

24. The article of insulation of claim 4 affixed to the corners of at least one end of a cylinder.

25. The article of insulation of claim 4 affixed to the corners of the OD of at least one end of a tube.

* * * * *

UNITED STATES PATENT AND TRADEMARK OFFICE

CERTIFICATE OF CORRECTION

PATENT NO. : 5,717,373

DATED : February 10, 1998

INVENTOR(S) : James E. Vachris

It is certified that error appears in the above-identified patent and that said Letters Patent is hereby corrected as shown below:

col., line 28, "222" should read --22--.

col. 4, line 40, "22" should read --23--.

claim 19, "1" should read --16--.

Signed and Sealed this

Ninth Day of June, 1998

*Attest:*

BRUCE LEHMAN

*Attesting Officer*

*Commissioner of Patents and Trademarks*